United States Patent [19]

Lewis et al.

[11] Patent Number: 4,993,359

[45] Date of Patent: Feb. 19, 1991

[54] APPARATUS FOR AND METHOD OF CHROMIZING ARTICLES

[75] Inventors: Everett C. Lewis, McDonald; Harley A. Grant, Harrison, both of Tenn.

[73] Assignee: Combustion Engineering, Inc., Windsor, Conn.

[21] Appl. No.: 451,706

[22] Filed: Dec. 15, 1989

Related U.S. Application Data

[62] Division of Ser. No. 210,906, Jun. 24, 1988, abandoned.

[51] Int. Cl.[5] ..... C23C 16/00; C23C 20/00

[52] U.S. Cl. ..... 118/717; 118/725

[58] Field of Search ..... 118/717, 725

[56] References Cited

U.S. PATENT-DOCUMENTS

| | | | |
|---|---|---|---|
| 3,622,374 | 11/1971 | Pike | 427/252 |
| 4,156,042 | 5/1979 | Hayman | 427/253 |
| 4,232,098 | 11/1980 | Park | 427/104 |
| 4,308,160 | 12/1981 | Baldi | 427/252 |
| 4,528,215 | 7/1985 | Baldi | 427/252 |
| 4,760,244 | 7/1988 | Hokynar | 118/725 |

*Primary Examiner*—Richard Bueker

*Attorney, Agent, or Firm*—Arther E. Fournier, Jr.

[57] ABSTRACT

An apparatus (10) and a method for applying a chromized coating (46,60,62,66) to one or more of the surfaces of an article (44,56,58,64) particularly in those situations in which the article (44,56,58,64) is intended to be employed in an application wherein the article (44,56,58,64) will be subject to corrosion. The subject apparatus (10) includes a foundation (12), a retort (16) for receiving the articles (44,56,58,64) to which the chromized coating is to be applied, an inlet (24) formed in the retort (16) for supplying a fluid medium therewithin, an outlet (26) formed in the retort (16) for enabling the fluid medium to exit therefrom after passing therethrough, supports (14) for supporting the retort (16) in spaced relation to the foundation (12), a furnace (28) which is movable to and from a position wherein the furnace (28) is located in surrounding relation to the retort (16) such that the furnace (28) is operative to effect the heating of the retort (16) for a preestablished period of time at a predetermined temperature, an inlet (38) formed in the furnace (28) for supplying a fluid medium therewithin, an outlet (40) formed in the furnace (28) for enabling the fluid medium to exit therefrom after passing therethrough, and seals (42) for sealing off the furnace (28) and thereby also the retort (16) from the environment surrounding the furnace (28) while the retort (16) is being heated by the furnace (28).

5 Claims, 3 Drawing Sheets

APPARATUS FOR AND METHOD OF CHROMIZING ARTICLES

This is a division, of application Ser. No. 210,906, filed June 24, 1988 now abandoned.

BACKGROUND OF THE INVENTION

This invention relates to the coating of articles, and more specifically to an apparatus for and a method of applying a chromized coating to one or more of the surfaces of an article as a means of providing protection thereto particularly with respect to corrosion.

It has long been known in the prior art that from the standpoint of being able to resist various forms of corrosion the most important alloying element insofar as steel is concerned is probably chromium. Furthermore, it has also long been known in the prior art that one means of providing the levels of chromium which are necessary in order to render steel resistant to such corrosion and/or oxidation is through the use of that process to which heretodate the term "chromizing" has commonly been applied in the prior art.

As used in the prior art, the term chromizing has come to mean a high temperature diffusion process in which the treated surface or surfaces of a steel object are alloyed with chromium. Briefly stated, in accord with this process the steel object is submerged in a retort in powder that contains chromium, the retort is sealed and is then heated along with its contents in a furnace for several hours at an elevated temperature. This heating causes the chromium in the powder to gasify, to deposit on the steel object, and to diffuse into the base metal of the steel object to a depth and in a concentration that is dependent upon numerous metallurgical and process variables. From the foregoing process there is produced a steel object which embodies an iron-chromium alloy coating that is metallurgically bonded as an integral part of the base metal of the steel object. Being that chromizing is a diffusion process, the structural modifications which result from the use of this process occur within the surface of the base metal and not on the surface itself. The significance of this is that since the diffused chromium has physically and metallurgically penetrated the base metal surface of the steel object, substituting for some of the iron atoms of the base metal in doing so, the diffused chromium is an integral part of the base metal of the steel object, and therefore, is not subject to spalling or peeling that characterize mechanical bonded coatings.

There are known to exist a number of different types of applications where it would be desirable to utilize components that have been chromized, i.e., that have had a chromium coating applied thereto. In this connection, by way of exemplification and not limitation, reference is had here in particular to various boiler related applications which are known to give rise to situations wherein there exists a need to combat the many forms of general and/or localized gas side corrosion and solid particle steam circle erosion caused by steam side oxide scale exfoliation.

Chemical recovery boilers are an example of one such boiler related application. A chemical recovery boiler essentially is an apparatus for recovering and processing certain chemicals which are used in a pulp mill. Of particular interest insofar as chemical recovery boilers are concerned is the so-called "black liquor", i.e., the spent cooling liquid that is generated during pulp making. It is this black liquor which is burned as fuel in the chemical recovery boiler. For many years the black liquor was burned in the chemical recovery boiler as a means of recovering chemicals before use was also made thereof to generate steam. The value of the chemicals that are recovered through the use of the chemical recovery boiler is normally on the order of three times greater than that of the steam generated by the chemical recovery boiler. Nonetheless, the steam generated by the chemical recovery boiler is a substantial amount i.e., perhaps half, of the steam that a pulp mill requires. However, unfortunately the black liquor which is burned as fuel in the chemical recovery boiler produces an environment which has proven to be highly corrosive to the carbon steel waterwalls of the chemical recovery boiler. As a result, for purposes of resisting this corrosion the boiler tubes which are employed in the waterwall panels of the chemical recovery units heretofore have either had to be replaced frequently and/or metallized, both necessitating a shutting down of the chemical recovery boiler in order to provide access thereto. Another option can be special composite tubes of carbon steel with an outside clad of Type 304 stainless steel but such tubes are relatively costly. An alternative thereto would be to employ boiler tubes that have been chromized, i.e., boiler tubes that have had a chromium coating applied thereto.

Another example of a boiler related application for which chromized components, i.e., components to which a chromium coating has been applied, appear to be particularly suited for use is that of resource recovery boilers. Because of the ever diminishing number of landfills that remain available for receiving municipal waste, more and more communities are resorting to burning their municipal waste. One means of accomplishing this burning of municipal waste that is being employed by such communities is through the use of a boiler of the type which is most frequently referred to by those in the industry as a resource recovery boiler. Unfortunately, however, it has been found that by virtue of its composition, i.e., because of the nature of the various types of materials that are to be found contained in municipal waste, the burning of such municipal waste in a resource recovery boiler frequently gives rise to a situation wherein at least some of the boiler tubes thereof are subjected to corrosion. Inasmuch as the burning of municipal waste in a boiler on the scale that is now being attempted represents a relatively recent development in terms of the types of applications in which boilers have historically been employed, there remains much to be learned with respect to the nature of the corrosion to which the boiler tubing of a resource recovery boiler will be subjected as a result of the burning of the municipal waste in the resource recovery boiler as well as with respect to the extent to which such boiler tubing of the resource recovery boiler will be subjected to this corrosion. Notwithstanding this though, there exists sufficient information which would appear to indicate that it would be possible to successfully resist such corrosion by utilizing chromized boiler tubing in the resource recovery boiler, i.e., boiler tubing that has had a chromium coating applied thereto.

Yet another example of a boiler related application for which chromized components, i.e., components to which a chromium coating has been applied, appear to be particularly suited for use is that of the gasifier which is designed to be employed in a coal gasification process. There existed considerable interest in the United States, particularly during the 1970's, in developing a commercial version of a coal gasification process for producing synthetic gas from coal. In support of such a developmental effort funding was made available during this period not only by the U.S. government but also by a number of large U.S. companies. The level of interest in the United States in pursuing coal gasification on a commercial scale subsided significantly with the subsequent drop in oil prices. On the other hand, although the level of interest in pursuing coal gasification on a commercial scale remains relatively low at the present time in the United States, considerable interest has relatively recently been evidenced in coal gasification overseas. As a consequence in particular of this latter interest attention is now being focused on ways to combat the corrosion to which it has been known the internal components of the gasifier are subjected in the course of the operation of the gasifier. As in the case of the resource recovery boiler discussed previously herein, there remains much to be learned with respect to the nature of the corrosion to which the internal components of the gasifier are subjected in the course of the operation of the gasifier as well as with respect to the extent to which the internal components of the gasifier will be subjected to this corrosion. Notwithstanding this though, sufficient information does exist from which a conclusion can be drawn that it appears that it would be possible to successfully resist such corrosion by chromizing internal components of the gasifier, i.e., by applying a chromium coating thereto.

Coal-fired utility boilers represent still another example of a boiler related application for which chromized components, i.e., components to which a chromium coating has been applied, appear to be particularly suited for use. To this end, it is known that coal-fired utility boilers, especially of the supercritical pressure type, have suffered general and/or localized attack of the waterwalls thereof. Moreover, metallizing has not proven to be effective in combating this very aggressive sulfidizing environment. On the other hand, there are indications that components which have had a chromium coating applied thereto are resistant, even when located in areas in which severe metal loss has previously been encountered, to such sulfidation attack and metal loss.

Continuing with the discussion of boilers, the superheater and the reheater sections thereof have been known to suffer from high temperature ash corrosion and oxidation. This high temperature ash corrosion and oxidation in the superheater and reheater sections of such boilers can be addressed in some instances by upgrading the material from ferritic steel to austenitic stainless steel. However, due to the differing coefficients of thermal expansion of ferritic and austenitic stainless steel, there are other instances wherein it is desirable, or even necessary, to continue to utilize a ferritic steel as the material from which some or all of the components in the superheater section and/or the reheater section of the boiler are fabricated. In cases such as these, it appears that the use of chromizing, i.e., applying a chromium coating to such ferritic alloy components, will be of benefit in providing resistance to ash corrosion and will also significantly raise the oxidation limit of the base metal of these components, i.e., of the ferritic alloy material from which these components are fabricated. With further reference to the matter of differing coefficients of thermal expansion, the fact that materials expand at different rates is particularly a concern in retrofit applications wherein because the original design was based on the use of ferritic material it may not be feasible to now replace the ferritic material with austenitic material or vice versa, i.e., where the original design was based on the use of austenitic material to now attempt to replace the austenitic material with ferritic material. Thus, there exists the need to employ components fabricated from ferritic alloy materials. However, in doing so there also exists a need to do something to raise the oxidation limit of the ferritic alloy material. Such a result can be had by employing components fabricated from ferritic alloy material that have been chromized on the outside and the inside, i.e., have had a chromium coating applied thereto on the outside and the inside thereof. By doing so, a component would be provided that would be expected to have a significantly longer life than a component fabricated from ferritic alloy material which had not been chromized.

With further reference to the matter of oxidation, the steam side oxidation product that forms on the tubes in the superheater section and the reheater section of the boiler which are touched by gas is known to have a potential for producing significantly increasing metal temperatures. Moreover, there have been boiler tube failures attributed to the formation of heavy internal oxides on the tube surfaces. By way of contrast, the oxide scale that forms on surfaces to which a chromium coating has been applied have been found to be extremely thin. Consequently, because the oxide scale is extremely thin, the metal temperature of boiler tubes fabricated from ferritic alloy material that have been chromized, i.e., have had a chromium coating applied thereto, will not increase significantly even when subjected to hours of operation.

Reference will next be had herein to the matter of a form of metal wastage often referenced as corrosion fatigue, circumferential grooving, elephant hiding, etc. With regard thereto boiler tubes that have the fire sides thereof, i.e., the sides thereof which are presented to the fire in the boiler, exposed to a high front to back temperature differential, e.g., usually those that are exposed to radiant heat, are sometimes found to have suffered circumferential cracking. While the cause of such circumferential cracking is not completely understood it is believed that it is induced by thermal strains, the mechanism by which the penetration of the base metal, i.e., the cracking thereof, occurs is as a consequence of the repeated cracking of the semi-protective oxidation product formed on the boiler tube surface. The waterwall tubes of coal-fired utility boilers, especially of the supercritical pressure type, that experience sulfidation wastage attack are known to also experience corrosion fatigue cracking particularly in those areas thereof which are outside of the regions wherein severe metal loss is experienced. Further, it is known that radiant wall tubes in the reheater section of coal-fired boilers have also experienced this type of cracking, i.e., thermally induced corrosion fatigue cracking. In this case also, chromizing such boiler tubes, i.e., applying a chromium coating to the surface thereof, has shown itself to be quite resistant to the aforereferenced type of corrosion fatigue cracking, i.e., the thermally induced corrosion fatigue cracking which has been discussed above.

To thus summarize, based on the preceding discussion it should now be readily apparent, by way of exemplification and not limitation, that numbered among the various types of applications wherein there is a need to provide materials with protection against the oxidation and sulfidation which is known to occur on heat transfer surfaces and wherein applying a chromium coating to, i.e., chromizing, the surfaces of such materials has been found to be effective to provide such protection are those in the electric utility, paper, petrochemical, coal gasification and chemical process industries.

Continuing, as noted herein previously, it has long been known in the prior art to apply a chromium coating to the surface of a material. To date though the application of such coatings of chromium to the surface of a material have been disadvantageously characterized in two respects primarily. One of these is the fact that particularly insofar as the application of a chromium coating to the external surface of a component is concerned, it has heretofore only been possible to coat with chromium the external surfaces of relatively small size components, e.g., turbine blade size components. The reason for this stems from the fact that there is a need in applying a chromium coating to the surface of a material that this be done at a specified temperature. However, the larger the component the more difficult it is to maintain at this specified temperature the entire surface or surfaces of the component that it is desired to coat with chromium for the length of time required to effect the application of the coating of chromium thereto.

Notwithstanding whether the coating of chromium is applied to the external or the internal surface of the material the other disadvantage from which prior art methods of applying a chromium coating to the surface of a material have suffered is that the chromium coating which results therefrom is characterized in that it contains a large preponderance of grain boundary carbides. Reference is had here in this regard to the methods which form the subject matter of U.S. Pat. No. 4,208,453 which issued on June 17, 1980 and U.S. Pat. No. 4,290,391 which issued on Sept. 22, 1981. The reason why the presence in a chromium coating of a large preponderance of grain boundary carbides is considered to disadvantageously characterize the latter is that it has been found that such grain boundary carbides can cause the chromium coating to be susceptible to intergranular attack in some service environments. Efforts have been undertaken to overcome this disadvantage occasioned by the presence of a large preponderance of grain boundary carbides in a chromium coating through the minimization of the presence of grain boundary carbides therein. One way in which it has been sought to accomplish such minimization of the presence of grain boundary carbides in the chromium coating is to codiffuse vanadium with the chromium. The concept of codiffusing vanadium with the chromium forms the subject matter of U.S. patent application Ser. No. 68,922, which was filed by the Electric Power Research Institute (EPRI) on July 1, 1987 and which lists as one of the co-inventors thereof, E. Clyde Lewis, one of the inventors of the subject matter to which the present patent application is directed. Another way has been by using carbon stabilized low alloy base material as the material to which the coating of chromium is applied.

A need has, thus, been evidenced in the prior art for a new and improved apparatus and method for applying a coating of chromium to one or more of the surfaces of an article, be the surfaces the external or the internal surfaces thereof, particularly in those situations in which the article is intended to be employed in an application wherein the article will be subjected to corrosion. In addition, a need has been evidenced in the prior art for such an apparatus and method for applying a coating of chromium to the surface of an article wherein the chromium coating applied to the surface of an article in accord therewith is thicker than that which it has heretofore been possible to provide through the use of prior art chromium coating methods. Moreover, there has been evidenced in the prior art a need for such an apparatus and method for applying a coating of chromium to the surface of an article wherein the chromium coating applied to the surface of an article in accord therewith contains a higher concentration of chromium than that which heretofore it has been possible to achieve through the use of prior art chromium coating methods. Furthermore, there has been evidenced in the prior art a need for such an apparatus and method for applying a coating of chromium to the surface of an article wherein the article to the surface of which in accord therewith the chromium coating is applied is larger in size than the size of the articles to which it has heretofore been possible to apply a chromium coating to the surface thereof through the use of prior art chromium coating methods.

It is, therefore, an object of the present invention to provide a new and improved apparatus for applying a coating of chromium to one or more of the surfaces of an article as a means of protecting the latter.

It is another object of the present invention to provide a new and improved method of applying a coating of chromium to one or more of the surfaces of an article as a means of protecting the latter.

It is still another object of the present invention to provide such an apparatus and method for applying a coating of chromium to one or more of the surfaces of an article wherein the surfaces to which the coating of chromium is applied may be the external and/or the internal surfaces of the article.

A further object of the present invention is to provide such an apparatus and method for applying a coating of chromium to the surface of an article wherein the chromium coating that is applied in accord therewith is thicker than that which it has heretofore been possible to provide through the use of prior art chromium methods.

A still further object of the present invention is to provide such an apparatus and method for applying a coating of chromium to the surface of an article wherein the chromium coating that is applied in accord therewith contains a higher concentration of chromium than that which heretofore it has been possible to achieve through the use of prior art chromium coating methods.

Yet another object of the present invention is to provide such an apparatus and method for applying a coating of chromium to the surface of an article wherein the article to the surface of which in accord therewith the chromium coating is applied is larger in size than the size of the articles to which it has heretofore been possible to apply a chromium coating to the surface thereof through the use of prior art chromium coating methods.

Yet still another object of the present invention is to provide such an apparatus and method for applying a coating of chromium to the surface of an article which are relatively inexpensive to provide, which are relatively easy to employ and which are characterized in that the chromium coating provided thereby is better capable of resisting corrosion than the chromium coatings which heretofore have been available for use for the same purpose.

SUMMARY OF THE INVENTION

In accordance with one aspect of the present invention there is provided a new and improved apparatus for applying a chromium coating to one or more of the surfaces of an article particularly where the article is intended to be employed in an application wherein the article will be subjected to corrosion. The subject apparatus includes a stationary foundation which is preferably formed of a cast refractory material. Supported on the stationary foundation in spaced relation thereto by means of a plurality of supports that are positioned on the stationary foundation in spaced relation one to another is a retort. Within the retort are placed the articles to which the chromium coating is to be applied. At one location the retort has suitably formed therein an inlet opening through which a fluid medium is supplied to the interior of the retort. At another location the retort has suitably formed therein an outlet opening through which the fluid medium that enters the retort through the aforementioned inlet opening exits from the retort after flowing therethrough. The subject apparatus further includes a furnace suitably provided with heating means which is movable to and from a position such that when in the latter position the furnace is operative to effect by means of the heating means associated therewith the uniform heating of the retort for a preestablished period of time at a predetermined temperature. Like the retort the furnace has formed therein at one location thereof an inlet opening through which a fluid medium is supplied to the interior of the furnace, and at another location thereof the furnace has formed therein an outlet opening through which the fluid medium that enters the furnace through the inlet opening formed therein for this purpose exits from the furnace after flowing therethrough. Finally, the subject apparatus includes seals suitably positioned in sealing relation between the furnace and the stationary foundation so as to be operative to seal off the furnace and thereby also the retort from the environment surrounding the furnace while the retort is being heated by the heating means with which the furnace is provided.

In accordance with another aspect of the present invention there is provided a new and improved method of applying a chromium coating to one or more of the surfaces of an article particularly where the article is intended to be employed in an application wherein the article will be subjected to corrosion. The subject method includes the steps of providing a stationary foundation which is preferably formed of a cast refractory material, positioning a plurality of supports on the stationary foundation in spaced relation one to another, mounting a retort in supported relation on the supports, spreading a layer of a powder composed of a mix of ammonium chloride, alumina and ferrochromium over the bottom of the retort, positioning a layer of articles to which the chromium coating is to be applied on the layer of powder in the retort, covering the layer of articles with a layer of powder, alternately adding to the retort a layer of articles to which the chromium coating is to be applied and a layer of powder until the retort contains the desired number of articles, covering the last layer of articles with a predetermined thickness of powder, placing the lid of the retort thereon and sealing it in place, positioning a furnace containing heating means in surrounding relation to the retort, sealing off the furnace and thereby also the retort from the environment surrounding the furnace, supplying a fluid medium to the interior of the retort and in surrounding relation to the retort to purge air therefrom while commencing the heating of the retort by the heating means of the furnace, uniformly heating the retort for a preestablished period of time at a first predetermined temperature, cooling the retort to a second predetermined temperature, removing the furnace from its position in surrounding relation to the retort, removing the lid from the retort, removing the residue of powder and the chromium coated articles from the retort, and cleaning the residual powder from the chromium coated articles.

DESCRIPTION OF THE PREFERRED EMBODIMENT

Figure 1:
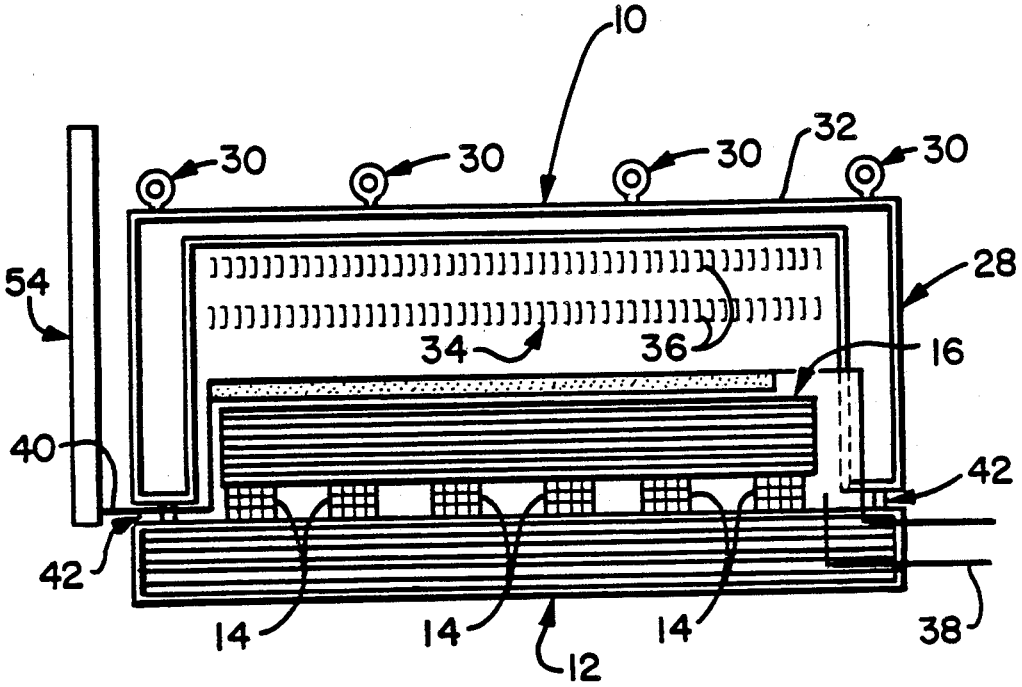
FIG. 1 is a schematic representation of an apparatus for applying a chromium coating to one or more of the surfaces of an article constructed in accordance with the present invention.

Referring now to the drawing and more particularly to FIG. 1 thereof, there is depicted therein an apparatus, generally designated by the reference numeral 10. In accord with one aspect of the present invention the apparatus 10 is designed to be operative for purposes of applying a chromium coating to one or more of the surfaces of an article, and especially an article that is intended to be employed in an application wherein the article will be subjected to corrosion.

Consideration will first be had herein to the nature of the construction of the apparatus 10. For this purpose, reference will be had in particular to FIGS. 1, 2 and 3 of the drawing. Thus, as best understood with reference to FIG. 1 of the drawing, the apparatus 10 includes a stationary foundation, the latter being generally designated by the reference numeral 12 in FIG. 1. In accord with the best mode embodiment of the invention, the stationary foundation 12 preferably is formed of a cast refractory material. The stationary foundation 12 is designed to serve a dual function. Namely, the stationary foundation 12 is intended to be in the nature of a support base for the apparatus 10. Secondly, by virtue of being formed from a cast refractory material the stationary foundation 12 is operative to provide a thermal insulation barrier between the apparatus 10 and the floor (not shown) of the facility whereat the apparatus 10 is located, e.g., the floor of an industrial-type facility.

With further reference to FIG. 1 of the drawing, the stationary foundation 12 has supported thereon in suitably spaced relation one to another a plurality of supports. For ease of reference thereto each of the plurality of supports is denoted in FIG. 1 by the same reference numeral, i.e., the reference numeral 14. In a fashion similar to that of the stationary foundation 12, the plurality of supports 14 are preferably each formed of a cast refractory material. Moreover, like the stationary foundation 12 the plurality of supports 14 are also designed to be operative to function as both a support surface and a thermal insulation barrier.

Figure 3:
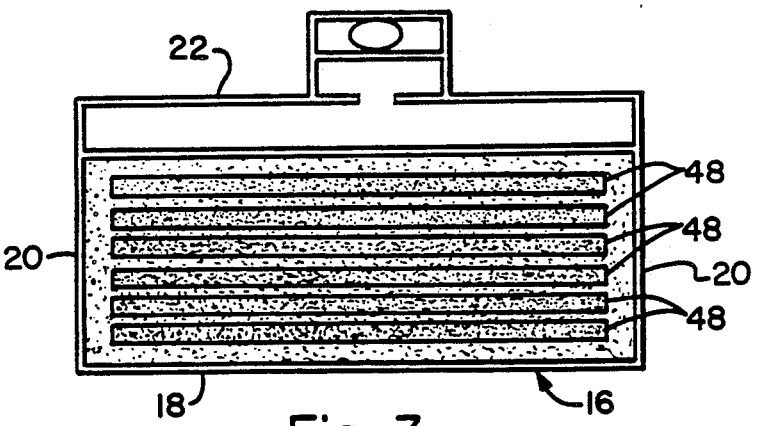
FIG. 3 is a cross-sectional view of the retort portion of the apparatus of FIG. 1 constructed in accordance with the present invention taken substantially along the line 3—3 in FIG. 2.
Figure 2:
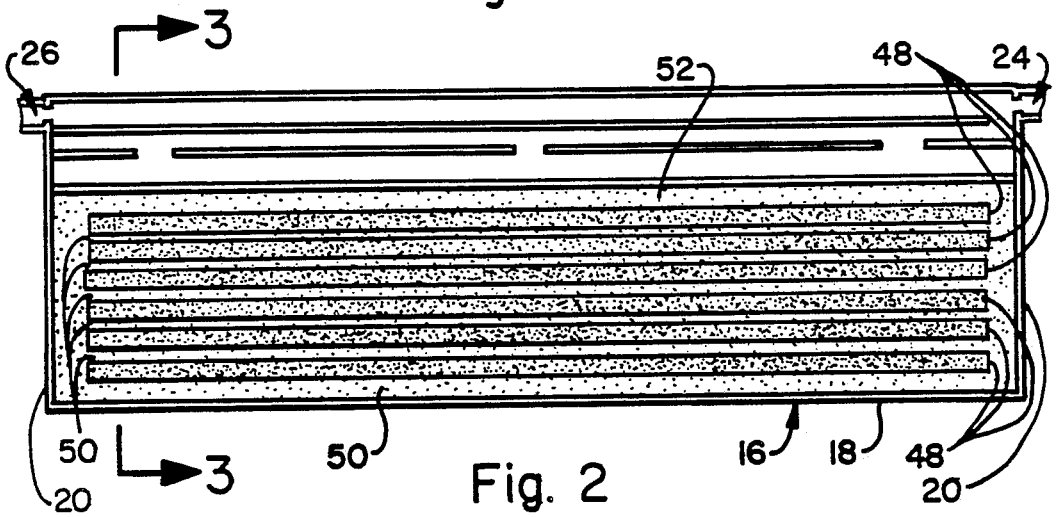
FIG. 2 is a schematic representation on an enlarged scale of the retort portion of the apparatus of FIG. 1 constructed in accordance with the present invention.

The support surface which the plurality of supports 14 provides is for the retort that is generally designated in FIGS. 1, 2 and 3 of the drawing by the reference numeral 16. It is within the retort 16 that the articles are placed which are to have a chromium coating applied to one or more surfaces thereof. The method by which the articles that are placed within the retort 16 have a chromium coating applied to one or more surfaces thereof forms another aspect of the present invention. Reference will be had herein in greater detail subsequently to this method. However, for purposes of the present description of the nature of the construction of the apparatus 10 of FIG. 1 of the drawings suffice it to say that the retort 16 is designed to function as the enclosure within which the articles that are to have a chromium coating applied to one or more surfaces thereof are place while these articles in a manner yet to be described herein are being uniformly heated for a preestablished period of time to a predetermined temperature for purposes of effecting the application of the chromium coating thereto. To this end, the retort 16 in accordance with the best mode embodiment of the invention is preferably formed of any suitable conventional type of material which embodies sufficient strength so as to be capable of supporting therewithin a multiplicity of relatively large objects, e.g., a multiplicity of relatively long, tubular metallic articles, while these objects are being heated to a temperature of on the order of 2100° F. Further, for ease of construction the retort 16 in accord with the best mode embodiment of the invention preferably takes the form of a rectangular structure defined by a base, identified in the drawing by the reference numeral 18 having four upstanding side walls, each denoted by the same reference numeral 20 in the drawing, connected thereto by means of any conventional connection means (not shown) suitable for use for such a purpose so as to thereby collectively form a closed box-like structure. In addition, the retort 16 includes a cover, identified by the reference numeral 22 in the drawing, which is designed to be removably secured to the top of the box-like structure formed by the base 18 and the upstanding side walls 20 connected thereto, so as to enable access to be had to the interior of the retort 16 for purposes of positioning therewithin the articles to which a chromium coating is to be applied to one or more surfaces thereof, and for thereafter removing these articles from the interior of the retort 16 once the chromium coating has been applied to the one or more surfaces of the articles. With further reference to the cover 22, the latter is designed to be sealed in place on the box-like structure formed by the base 18 and the upstanding side walls 20 once the articles to which the chromium is to be applied to one or more surfaces thereof have been emplaced within the latter while these articles are being heated to effectuate, in a manner yet to be described, the application of the chromium coating to one or more surfaces thereof.

Completing the description of the nature of the construction of the retort 16, for a purpose to be described in more detail hereinafter, the retort 16 is provided at a first location with inlet passage means, the latter being schematically illustrated in FIG. 2 of the drawing wherein the inlet passage means is generally designated by the reference numeral 24. The inlet passage means 24 is suitably formed in the retort 16 at a first location thereof such as to be operative for the purpose of enabling an inert fluid medium to be supplied therethrough to the interior of the retort 16. In addition, the retort 16 likewise for a purpose to be described in more detail hereinafter is also provided at another location thereof with outlet passage means, schematically illustrated in FIG. 2 of the drawing wherein the outlet passage means is generally designated by the reference numeral 26. The outlet passage means 26 is suitably formed in the retort 16 so as to be operative for the purpose of enabling the inert fluid medium, which is supplied to the interior of the retort 16 through the inlet passage means 24, to exit through the outlet passage means 26 after having flowed through the retort 16. In accord with the best mode embodiment of the invention, both the inlet passage means 24 and the outlet passage means 26 may embody any suitable conventional form of construction such that the inlet passage means 24 and the outlet passage means 26 are each capable of functioning in the manner desired thereof, i.e., as has been described hereinbefore.

Continuing with a description of the nature of the construction of the apparatus 10, as best understood with reference to FIG. 1 of the drawing the apparatus 10 further includes a furnace generally designated in the drawing by the reference numeral 28. In accord with the best mode embodiment of the invention, the furnace 28 preferably is substantially rectangular in configuration. More specifically, the furnace 28 is constructed so as to embody a configuration which is complementary to the configuration of the retort 16, but which in size, i.e., in terms of the dimensions thereof, is larger than that of the retort 16 such that the furnace 28 is movable between a first position wherein the furnace 28 is located in surrounding relation to the retort 16 in the manner depicted in FIG. 1 of the drawing and a second position (not shown) wherein the furnace 28 is located in nonsurrounding relation to the retort 16. For purposes of effecting the movement of the furnace 28 to and from surrounding relation to the retort 16, the furnace 28 is suitably provided with grasping means. The grasping means employed take the form of a plurality of conventional lugs such as those denoted by the reference numeral 30 in FIG. 1 of the drawing. The lugs 30 are suitably secured in spaced relation to one another preferably on the top, seen at 32 in FIG. 1, of the furnace 28 such as to project outwardly therefrom. The lugs 30 are designed to be engaged by means of an industrial-type crane, or any other similar piece of equipment which is suitable for use for such a purpose, to effectuate the moving of the furnace 28 to and from surrounding relation relative to the retort 16. However, it is to be understood that any conventional form of grasping means suitable for use for the aforedescribed purpose may be employed in lieu of the lugs 30 without departing from the essence of the present invention.

With further regard to the nature of the construction of the furnace 28, as best understood with reference to FIG. 1 of the drawing the furnace 28 embodies heating means, the latter being denoted generally by the reference numeral 34 in FIG. 1. The heating means 34 in accord with the best mode embodiment of the invention consists of a multiplicity of electrical heating elements 36 suitably positioned in supported relation within the furnace 28 such that when the furnace 28 is positioned in surrounding relation to the retort 16 in the manner illustrated in FIG. 1 of the drawing the multiplicity of electrical heating elements 36 are operative to effectuate the uniform heating to a predetermined temperature for a preestablished period of time of the retort 16 and thereby of also the contents of the retort 16, i.e., the articles which have been placed within the retort 16, for purposes of having a chromium coating applied to one or more surfaces thereof. There will be had herein subsequently additional reference to this matter of a predetermined temperature and a preestablished period of time. It will suffice for the moment, however, to simply point out that in accord with the best mode embodiment of the invention the predetermined temperature to which reference is being had herein is preferably a temperature of 2100° F., while the preestablished period of time to which reference is being had herein is preferably a period of ten hours. To this end, it has been found in accord with the present invention that in order to successfully accomplish the application desired in terms of quality, depth of coating, etc. of a chromium coating to one or more surfaces of an article the article and thereby concomitantly the surface or surfaces of the article to which the chromium coating is to be applied must be heated uniformly throughout to a temperature of 2100° F. which temperature must be continuously maintained for a period of ten hours notwithstanding what the overall dimensions, i.e., the length, width and height of the article might be. In this connection it has further been found that the larger the size of the article the more difficult it is to heat the article uniformly throughout to a temperature of 2100° F. and to continuously maintain the article at this uniform temperature of approximately 2100° F. for a period of ten hours. Finally, in accord with the present invention it has been found that virtually the only way that it is possible, particularly with respect to articles that are relatively large in size, to successfully achieve this heating of the article for purposes of effectuating the application of a chromium coating to the surface or surfaces thereof uniformly throughout to a temperature of 2100° F. and to thereafter continuously maintain the article at a temperature of approximately 2100° F. over a period of ten hours is to employ as the heating means 34 with which the furnace 28 is suitably provided the multiplicity of electrical heating elements 36 which have been described hereinabove. With gas and oil heating means it has been found to be more difficult to achieve the uniform heating that is required for purposes of achieving a successful application of the desired chromium coating to the surface or surfaces of the article.

Referring again to the description of the nature of the construction of the furnace 28, for a purpose to be described in detail hereinafter the furnace 28 as best understood with reference to FIG. 1 of the drawing is, in a manner similar to that described hereinbefore in connection with the discussion of the nature of the construction of the retort 16, provided with inlet passage means, the latter being schematically illustrated in FIG. 1 of the drawing wherein the inlet passage means is generally designated by the reference numeral 38. The inlet passage means 38 is suitably formed in the furnace 28 at a first location thereof such as to be operative for the purpose of enabling a fluid medium to be supplied therethrough to the interior of the furnace 28. In addition, the furnace 28 likewise for a purpose to be described in more detail hereinafter is also provided at another location thereof with outlet passage means, the latter being schematically illustrated in FIG. 1 of the drawing wherein the outlet passage means is generally designated by the reference numeral 40. The outlet passage means 40 is suitably formed in the furnace 28 so as to be operative for the purpose of enabling the fluid medium, which is supplied to the interior of the furnace 28 through the inlet passage means 38, to exit through the outlet passage means 40 after having flowed through the furnace 28. In accord with the best mode embodiment of the invention, both the inlet passage means 38 and the outlet passage means 40 may embody any suitable conventional form of construction which will enable the inlet passage means 38 and the outlet passage means 40 to function in the manner desired thereof, i.e., as has been described hereinbefore.

Completing the description of the nature of the construction of the furnace 28, in accord with the best mode embodiment of the invention the multiplicity of electrical heating elements 36 of the heating means 34 which are supported within the furnace 28 are suitable enshrouded by conventional insulation means (not shown) such that the heat being generated by the multiplicity of electrical heating elements 36 does not escape to the exterior of the furnace 28 but rather does in fact accomplish the heating of the retort 16 and the articles emplaced therewithin to the extent required in order to successfully effectuate the application in the manner which has been described hereinbefore of a chromium coating to the articles that are in the retort 16. Any known conventional form of insulation means capable of performing in the aforedescribed manner may be selected for use for this purpose.

Finally, insofar as the nature of the construction of the apparatus 10 is concerned, the apparatus 10 as best understood with reference to FIG. 1 of the drawing includes sealing means, the latter being schematically illustrated in FIG. 1 of the drawing wherein the sealing means is identified generally by the reference numeral 42. The sealing means 42 as shown in FIG. 1 of the drawing is designed so as to be capable of being interposed between the furnace 28 and the stationary foundation 12. To this end, the sealing means 42 is designed to be operable to provide a seal between the furnace 28 and the stationary foundation 12 when the retort 16 is positioned in the manner depicted in FIG. 1 of the drawing wherein the retort 16 is being supported on the stationary foundation 12 by virtue of being positioned on the plurality of supports 14 and the furnace 28 has been moved into surrounding relation relative to the retort 16 whereby the furnace 28 occupies the position relative to the retort 16 that is shown in FIG. 1 of the drawing. That is, the sealing means 42 is intended to be operative to seal off the furnace 28 and thereby also the retort 16 from the environment surrounding the furnace 28 while the retort 16 as well as the articles emplaced therewithin are being heated to the desired temperature for the required period of time by the multiplicity of electrical heating elements 36 of the heating means 34 with which as has been described in detail hereinbefore the furnace 28 is suitably provided. In this regard, any known conventional form of sealing means capable of being employed in the aforedescribed manner, e.g., having the strength to resist the weight applied thereto by the furnace 28 and to resist the high temperatures to which the sealing means 42 will be subjected for a prolonged period of time, may be utilized as the sealing means 42 in the apparatus 10. Further, as a matter of convenience in the use thereof, the sealing means 42 may be suitably mounted on the furnace 28 so as to be movable therewith into and out of sealing engagement with the stationary foundation 12.

Attention will next be focused herein to another aspect of the present invention. In accord therewith and as will be described in more detail hereinafter, there is provided a method of applying a chromium coating to one or more of the surfaces of an article, and particularly to one or more surfaces of those articles which are of the type that are intended to be employed in applications wherein the articles will be subjected to corrosion. For purposes of practicing this method, in accordance with the best mode embodiment of the invention use is preferably made of the apparatus 10 that has been described in detail hereinbefore and which in whole or in part is illustrated in each of FIGS. 1, 2 and 3 of the drawing.

Continuing, in accord with this aspect of the present invention there is provided a method of applying a chromium coating to one or more of the surfaces of an article wherein the subject method consists of the steps which are described hereinafter. For purposes of this description of the steps of the subject method, reference will be had in particular to FIGS. 1, 2 and 3 of the drawing. Commencing with a description of the steps of the subject method, first there is provided a stationary foundation which may, for example, take the form of the stationary foundation 12 that is depicted in FIG. 1 of the drawing. This stationary foundation in accord with the best mode embodiment of the invention preferably is made of a suitable conventional form of cast refractory material. Next, a plurality of supports such as, for instance, the supports 14 shown in FIG. 1 of the drawing are positioned on the stationary foundation in suitably spaced relation one to another. Thereafter, a retort having a cover, and which in accord with the best mode embodiment of the invention, preferably embodies a construction such as that of the retort 16 depicted in FIGS. 1, 2 and 3 of the drawing is positioned, absent the cover thereof, in suitably supported relation on the plurality of supports to which hereinbefore reference has been had.

Figure 4:
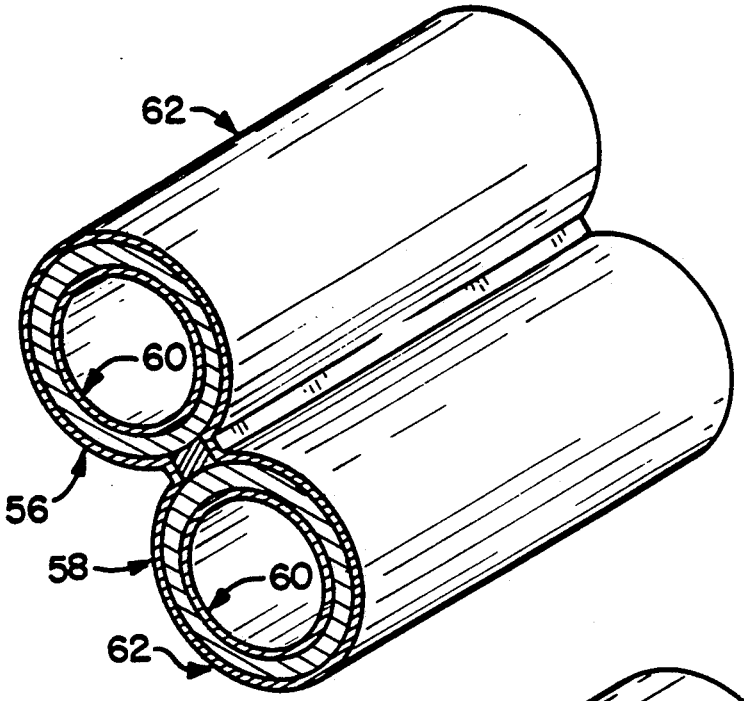
FIG. 4 is a perspective view of a pair of tubular members to which a chromium coating has been applied to both the outer surface and the inner surface thereof by means of the apparatus and method for applying a chromium coating to one or more surfaces of an article in accordance with the present invention.
Figure 5:
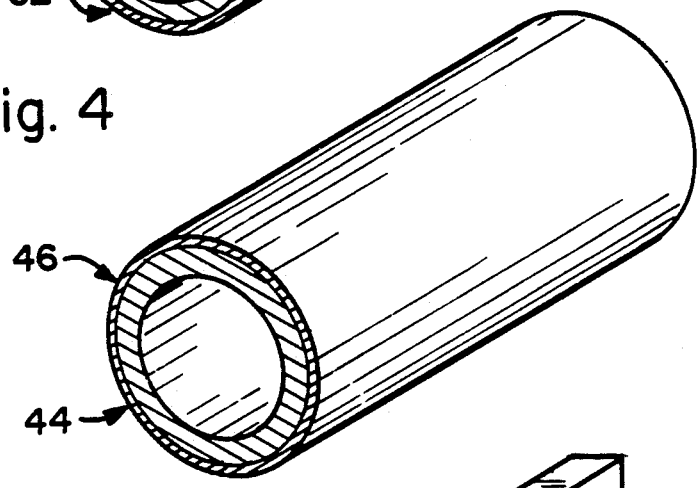
FIG. 5 is a perspective view of a tubular member to which a chromium coating has been applied to the outer surface thereof by means of the apparatus and method for applying a chromium coating to one or more surfaces of an article in accordance with the present invention.
Figure 6:
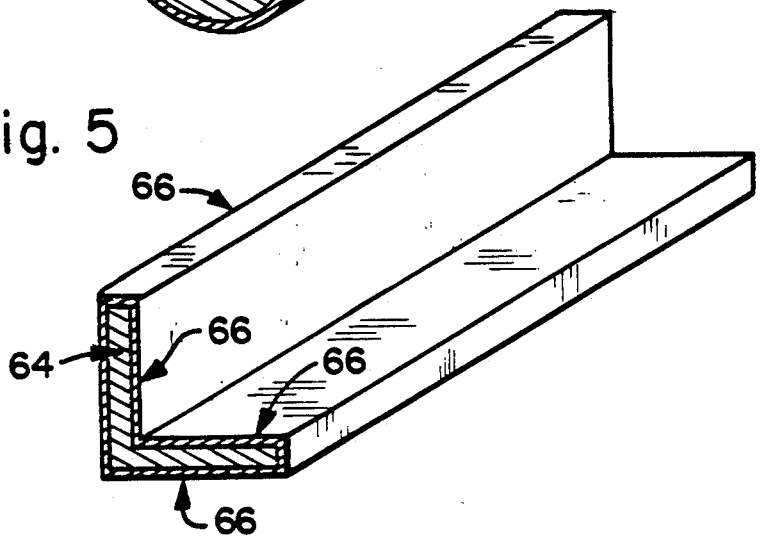
FIG. 6 is a perspective view of a non-tubular member to which a chromium coating has been applied to the outer surface thereof by means of the apparatus and method for applying a chromium coating to one or more surfaces of an article in accordance with the present invention.

Resuming herein with the description of the nature of the steps that in accord with this aspect of the present invention comprise the subject method, with the cover removed from the retort for purposes of providing access to the interior thereof a layer of powder is then spread over the bottom of the retort. In accord with the best mode embodiment of the invention, this powder preferably is composed of a mix of ammonium chloride, alumina and ferrochromium. Next, a layer of articles which may, for example, be in the form of a plurality of the articles, i.e., a plurality of the pairs of joined tubular members, which are depicted in FIG. 4 of the drawing, or which may be in the form of a plurality of the article, i.e., a plurality of the single tubular member, which is depicted in FIG. 5 of the drawing, or which may be in the form of a plurality of the article, i.e., a plurality of the non-tubular member, which is depicted in FIG. 6 of the drawing is placed in the retort on top of the aforedescribed layer of powder which has been spread over the bottom of the retort. It is to be understood, however, that the articles which are illustrated in each of FIGS. 4, 5 and 6 of the drawing are intended to be only representative of the type of articles to the surface or surfaces of which a chromium coating may be applied in accord with the practice of the subject method of the present invention. Namely, other types of articles such as, by way of exemplification and not limitation, articles embodying the configuration of an I-beam, or articles embodying a cup-like configuration, etc., may like the articles shown in each of FIGS. 4, 5 and 6 of the drawing have a chromium coating applied to one or more surfaces thereof in accordance with the practice of the subject method without departing from the essence of the present invention. Thereafter, this layer of articles which has been emplaced within the retort is covered with a layer of powder consisting of the same mix, i.e., ammonium chloride, alumina and ferrochromium, as that of the layer of powder which in the manner described hereinbefore has been spread over the bottom of the retort. Following this, a layer of articles and a layer of powder of the same mix as that which has been described hereinabove are alternately added to the retort until the retort's capacity to receive articles is reached, or until the desired number of articles have been emplaced in the retort if this number of articles is less than the number of articles that is required to reach the retort's capacity to receive articles therewithin. The uppermost layer, i.e., the last layer of articles is then covered with a layer of powder of the same mix as that described herein previously. In accord with the best mode embodiment of the invention this layer of powder is of a predetermined thickness. Once the last layer of articles has been covered with this layer of powder of predetermined thickness, the cover, i.e., the lid, of the retort is suitably positioned on the retort so as to close off access to the interior thereof, and is then sealed in place through the use of any conventional form of sealing means suitable for use for such a purpose as, for example, welding, that is by welding the cover in place on the retort.

After the retort has been filled with the desired number of articles to the surface or surfaces of which it is desired to apply a chromium coating and the cover of the retort has been sealed in place thereon, a furnace containing heating means is positioned in surrounding relation to the retort. To this end, the furnace is designed so as to be movable into and out of surrounding relation relative to the retort. In accord with the best mode embodiment of the invention, this furnace preferably embodies a construction such as that of the furnace 28 which is illustrated in FIG. 1 of the drawing. Whether the furnace 28 is the furnace of which use is made in the course of practicing the subject method in accord with this aspect of the present invention or not, it is essential to the successful practice of the subject method that the furnace which is employed in this connection be capable of heating to a predetermined temperature for a preestablished period of time articles which are relatively large in size such that each article is heated throughout uniformly to this predetermined temperature and once having been heated uniformly to this predetermined temperature the article is capable of being maintained continuously at this uniform predetermined temperature throughout for a preestablished period of time, i.e., for a relatively prolonged period of time, e.g., on the order of upwards of ten hours. Once the furnace has been positioned in the aforedescribed manner in surrounding relation to the retort, the furnace and thereby also the retort are next sealed off from the environment surrounding the furnace. In accord with the best mode embodiment of the invention, this sealing off of the furnace and of the retort is preferably accomplished through the use of sealing means such as the sealing means identified in FIG. 1 of the drawing by the reference numeral 42.

Thereafter, the heating of the articles that are emplaced within the retort to a predetermined temperature for a preestablished period of time is commenced. This heating of the articles is accomplished by means of the heating means with which the furnace is suitably provided for this purpose. At the same time that this heating of the articles is commencing, a fluid medium is being supplied to the interior of the retort through conventionally constructed inlet passage means with which the retort is suitably provided for this purpose. This fluid medium is designed to be operative to effect a purging of air from the interior of the retort. After flowing through the interior of the retort the fluid medium that is supplied thereto exits from the retort through conventionally constructed outlet passage means with which the retort is suitably provided for this purpose. In addition to the fluid medium that is being supplied to the interior of the retort, a fluid medium is also simultaneously being supplied to the interior of the furnace, i.e., in surrounding relation to the retort, through conventionally constructed inlet passage means with which the furnace is suitably provided for this purpose. The fluid medium supplied to the interior of the furnace, i.e., in surrounding relation to the retort, is like the fluid medium supplied to the interior of the retort designed to be operative to perform a purging function. More specifically, the fluid medium supplied to the interior of the furnace, i.e., in surrounding relation to the retort, is designed to be operative to purge the air from the area to which the fluid medium is supplied. After flowing through the interior of the furnace the fluid medium that is supplied thereto exits from the furnace through outlet passage means with which the furnace is suitably provided for this purpose.

Thereupon, the heating of the articles emplaced in the retort by the heating means with which the furnace is provided for this purpose continues until such time as the articles that are emplaced within the retort are heated uniformly throughout to a first predetermined temperature whereupon these articles are continuously maintained uniformly throughout at this first predetermined temperature for a preestablished period of time. Once this preestablished period of time has elapsed, the heating means with which the furnace is provided is shut off, and the retort and thereby also the articles emplaced in the retort are permitted to cool down. This cooling down of the articles emplaced in the retort continues until these articles have cooled down uniformly throughout to a second predetermined temperature.

When this second predetermined temperature is reached the furnace is then removed from in surrounding relation relative to the retort. Next, the cover is removed from the retort. With the cover of the retort removed, the residue of the powder mix and the articles emplaced within the retort to which a chromium coating has now been applied to one or more surfaces thereof are removed from the interior of the retort. Thereafter, the residual powder still on the surfaces of the articles is cleaned therefrom. Once the articles have been cleaned of residual powder, the articles then may be subjected to heat treatment and/or any other form of manufacturing process steps to which it may be deemed desirable to subject the articles.

By way of exemplification and not limitation there will now be set forth herein an example of the practice of the subject method in accord with this aspect of the present invention. For purposes of this example, the article to which a chromium coating is to be applied to one or more surfaces thereof shall be the tubular member which is illustrated in FIG. 5 of the drawing wherein the tubular member is generally designated by the reference numeral 44. Moreover, for purposes of this illustration of the practice of the subject method in accord with the present invention, the surface of the tubular member 44 to which the chromium coating will be applied shall be the outer circumference thereof whereby the tubular member 44 is provided with a chromium coating in the manner that is depicted in FIG. 5 of the drawing wherein the chromium coating is denoted generally by the reference numeral 46.

Thus, to apply a chromium coating in the manner of the chromium coating identified by the reference numeral 46 in FIG. 5 of the drawing to the outer circumference of a tubular member such as the tubular member 44 illustrated in FIG. 5 of the drawing, the following steps in accord with the practice of the subject matter of this aspect of the present invention are preferably performed. First, there is provided a stationary foundation such as the stationary foundation 12 made of a suitable cast refractory material which is depicted in FIG. 1 of the drawing. Next, a plurality of supports such as the plurality of supports 14 shown in FIG. 1 of the drawing are positioned on the stationary foundation in suitably spaced relation one to another. Thereafter, a retort having a cover and embodying preferably a construction such as that of the retort 16 depicted in FIGS. 1, 2 and 3 of the drawing is suitably placed absent the cover thereof on the plurality of supports so as to thereby be suitably supported by the stationary foundation.

With the cover removed from the retort so as to provide access to the interior of the retort, a layer of powder approximately one-half inch thick is spread evenly over the bottom of the retort. The powder employed for this purpose is in the form of a mixture consisting of 3% ammonium chloride, 55% alumina and 42% ferrochromium. In this regard insofar as concerns the possible reuse of the residue of powder that remains after applying in accord with the practice of the subject matter of this aspect of the present invention a chromium coating to one or more surfaces of an article, it has been found that it is possible to reuse this residue of powder so long as the latter is mixed in a ratio of approximately 25% of new powder to 75% of previously used powder. Thereafter, a first layer of tubular members 44 is placed on this layer of powder which has been spread over the bottom of the retort. However, before this layer of tubular members 44 as well as all subsequent layers of tubular members 44 are emplaced in the retort, air is first purged from the interior of each tubular member 44 by passing an inert gas such as argon through the interior of each of the tubular members 44. Further, once the interior of each of the tubular members 44 in each layer thereof that is to be emplaced within the retort has been purged of air a suitably constructed plug, preferably of sheet-metal construction, is suitably installed in each end of each of the tubular members 44 so as to bear a tight-fitting relation thereto.

Continuing, once this first layer of tubular members 44 has been emplaced in the retort, a layer of the same mix of powder as that spread over the bottom of the retort is now spread in a thickness of approximately one-half inch over the layer of tubular members 44. Following this, a layer of tubular members 44 and a layer of the same powder mix and in the same thickness of approximately one-half inch are alternately added to the retort until the retort's capacity to receive layers of tubular members 44 is reached, or until the desired number of layers of tubular members 44 has been emplaced in the retort if this number of layers of tubular members 44 is less than the number of layers of tubular members 44 that is required to reach the retort's capacity for receiving such items. In accord with the illustrated embodiment of the invention and as best understood with reference to FIGS. 2 and 3 of the drawing, six such layers of tubular members 44 and six such approximately one-half inch thick layers of powder including the layer of powder spread over the bottom of the retort are capable of being emplaced within the retort before reaching the retort's capacity to receive layers of tubular members 44. For ease of identification with reference to FIGS. 2 and 3 of the drawing each such layer of tubular members 44 is identified in FIGS. 2 and 3 by the same reference numeral 48 and each such approximately one-half inch thick of powder including the layer thereof that is spread over the bottom of the retort is identified in FIGS. 2 and 3 by the same reference numeral 50. After the last, i.e., the sixth in accord with the illustrated embodiment of the invention, of the layers of tubular members 44 has been emplaced in the retort, this last layer 48 of tubular members 44 is covered by a layer, denoted in FIG. 2 by the reference numeral 52, of approximately four inch thickness of the same mix of powder as that of the other layers 50 of powder which in accordance with the preceding description have previously been provided in the interior of the retort.

The cover to the retort is then positioned thereon and is sealed in place by being welded thereto. Following this, the inlet passage means and the outlet passage means with which the retort is suitably provided are connected in fluid flow relation to a suitable supply of a fluid medium, e.g., an inert gas such as argon, suitable for accomplishing a purging of air from the interior of the retort. Thereafter, the furnace is suitably moved, such as through the engagement by a conventional industrial-type crane with the lugs with which the furnace is suitably provided for this purpose, into surrounding relation to the retort whereby the heating means of the furnace is capable of heating the layers 48 of tubular members 44 that have been emplaced within the retort in the manner that has been described hereinabove. Subsequent to the furnace being so positioned in surrounding relation to the retort, the inlet passage means and the outlet passage means with which the furnace is suitably provided are connected in fluid flow relation with a suitable supply of a fluid medium, e.g., an inert gas such as argon, suitable for effecting a purging of air from within the furnace, i.e., from within the area surrounding the retort.

The heating of the layers 48 of tubular members 44 by the heating means of the furnace is then commenced. Simultaneously with the commencement of the heating of the layers 48 of tubular members 44 by the heating means of the furnace, a flow of an inert gas is begun through the inlet passage means of the retort into the interior of the retort and through the inlet passage means of the furnace into the area within the furnace that surrounds the retort. During the course of this heating up of the layers 48 of tubular members 44 emplaced within the retort there are fumes generated. These fumes are carried out of the retort through the outlet passage means with which the retort is suitably provided by the inert gas flowing through the retort, and are carried out of the area within the furnace located in surrounding relation to the retort through the outlet passage means with which the furnace is suitably provided by the inert gas flowing through the furnace. Preferably, these fumes as well as the inert gases exiting through the outlet passage means of the retort and the outlet passage means of the furnace are in accordance with the illustrated embodiment of the invention caused to flow into and through a stack, the latter being denoted generally by the reference numeral 54 in the drawing, before being discharged to the atmosphere. As these fumes begin to build up they are ignited in any suitable manner through the use of any conventional form of igniting means (not shown) suitable for use for such a purpose. This igniting of the fumes is made to occur after the fumes leave the retort and the area within the furnace located in surrounding relation to the retort such that the fumes are burned off before they can be discharged from the stack 54 to the atmosphere.

This heating of the layers 48 of the tubular members 44 that are emplaced in the retort by the heating means of the furnace and the flow of the inert gas through the retort and through the area within the furnace located in surrounding relation to the retort continues until in the case, for example, wherein the chromium coating to be applied is to be applied to the outer circumference of the tubular members 44, the coolest location in the retort has reached a first predetermined temperature of 2100° F. Moreover, this predetermined temperature of 2100° F. is thereafter continuously maintained for a preestablished period of ten hours. It is to be understood in this connection though that in cases wherein the nature of the chromium coating to be applied is other than the application of a chromium coating to the outer circumference of the tubular member 44, the predetermined temperature to which such other articles may need to be heated in order to successfully accomplish the application of a chromium coating to one or more surfaces thereof may vary, i.e., may be other than 2100° F., e.g., a lesser temperature than 2100° F. such as a temperature lying in the range of 1700° F. to 2100° F. Likewise, for applications wherein the nature of the chromium coating to be applied is other than the application of a chromium coating to the outer circumference of tubular member 44, the preestablished period of time for which the predetermined temperature must be continuously maintained for purposes of successfully accomplishing the application of the chromium coating to one or more of the surfaces thereof may need to be other than ten hours, e.g., for some period in excess of ten hours.

When the tubular members 44 have been heated to the predetermined temperature, i.e., 2100° F., and have been continuously maintained at this predetermined temperature of 2100° F. for the preestablished period of time, i.e., ten hours, the heating means of the furnace is turned off and the flow of inert gas through the interior of the retort and through the area of the furnace that surrounds the retort is shut off whereupon a cooling down of the layers 48 of tubular members 44 emplaced in the retort commences. This cooling down of the layers 48 of the tubular members 44 emplaced in the retort continues until the hottest location within the retort has cooled down to a second predetermined temperature. In the case of the layers 48 of the tubular members 44 emplaced in the retort this second predetermined temperature is 400° F. It is to be understood here though that for applications wherein the nature of the chromium coating to be applied is other than the application of the chromium coating to the outer circumference of a tubular member 44 for purposes of successfully accomplishing the application of the chromium coating to one or more surfaces of the particular article in question this second predetermined temperature may vary, i.e., may be other than 400° F. Once the hottest location in the retort has cooled down to the second predetermined temperature of 400° F., the inlet passage means and the outlet passage means of the furnace are suitably disconnected so as to enable the furnace to be removed from in surrounding relation relative to the retort. The furnace is then removed from in surrounding relation relative to the retort through the engagement by a conventional industrial-type crane with the lugs with which the furnace is suitably provided for this purpose. With the furnace removed from in surrounding relation relative to the retort, the inlet passage means and the outlet passage means are likewise similarly disconnected. Lastly, the cover is removed from sealing engagement with the retort.

After the cover has been removed from the retort, the residual powder remaining in the retort and the layers 48 of tubular members 44 emplaced within the retort are removed therefrom. Each tubular member 44 is then cleaned off, i.e., any residual powder remaining thereon is removed therefrom. If there exists a need therefor, the tubular members 44 are then heat treated. Once the tubular members 44 have been so heat treated, they are inspected for physical integrity and as needed the tubular members 44 are subjected to a straightening operation in order to correct any deformation to which the tubular members 44 may have been subjected in the course of having the chromium coating applied to the outer circumference thereof. Thereafter, any weld connections that may be required to be made to the tubular members 44 are made thereto and/or any other associated fabrication to which the tubular members 44 may need to be subjected is performed thereon. Following this, the tubular members 44 to the extent required thereby are once again subjected to heat treatment, whereupon the last step in the successful accomplishment of the application of the chromium coating 46 to the outer circumference of each of the tubular members 44 that needs to be performed, i.e., that of performing a final inspection of each of the tubular members 44, is conducted.

Although the practice of the subject method in accord with this aspect of the present invention has been described in detail hereinabove with reference in particular to the application to the tubular member 44 of a chromium coating 46 on the outer circumference thereof, it is nevertheless to be understood that as has been set forth previously herein the subject method in accord with this aspect of the present invention can equally well be utilized without departing from the essence of the present invention for purposes of applying a chromium coating to one or more of the surfaces of some other article. To this end, the subject method in accord with this aspect of the present invention is equally applicable for use for purposes of applying a chromium coating to one or more of the surfaces of an article such as, by way of exemplification and not limitation, the joined tubular members denoted generally by the reference numerals 56 and 58 in FIG. 4 of the drawing wherein the joined tubular members 56 and 58 are illustrated with chromium coatings denoted generally by the reference numerals 60 and 62 applied to the inner circumference and to the outer circumference, respectively, thereof, or such as the non-tubular member, denoted generally by the reference numeral 54 in FIG. 6 wherein the non-tubular member 64 is illustrated with a chromium coating denoted generally by the reference numeral 66 applied to all of the outer surfaces thereof.

Next, there will be described herein a modification that can be had to the subject method in accordance with this aspect of the present invention, as it has been described hereinabove, without departing from the essence of the present invention. In accord therewith, for purposes of providing the articles that have had a chromium coating applied to one or more surfaces with additional strength, the subject surfaces thereof to which the chromium coating has been applied may be subjected to shot peening. The effect of shot peening as a manufacturing process step is well-known to those skilled in the manufacturing art. It had not been known though prior to the making of the present invention that it would be possible without adversely affecting the efficacy of the chromium coating to shot peen surfaces to which a chromium coating had been applied in accord with the subject matter of the present invention. However, whether the chromium coating is applied as a result of the chromium component being painted on the surface of the article in slurry form or whether the chromium component is mixed in powder form with ammonium chloride and alumina and applied as a layer thereof, the chromium coating that results from the practice of the subject method in accord with this aspect of the present invention may be subjected to shot peening thereby rendering it possible to realize all of the benefits that are known to accrue from subjecting a surface to shot peening without adversely affecting the efficacy of the chromium coating itself, i.e., the capability of the chromium coating to resist corrosion.

By way of a very general summarization thereof it can, therefore, be said that chromizing consists of the submerging within a retort in a powder mixture containing a chromium component the steel article or articles to which a chromium coating is to be applied to one or more surfaces thereof, followed by the sealing of the retort and then the heating of the retort and its contents to a predetermined elevated temperature in a furnace for a preestablished period of time, i.e., for several hours. As a result of this heating, the chromium component in the powder mixture gasifies and in doing so deposits on the surface or surfaces of the steel article or articles that are submerged in the powder mixture within the retort such that the chromium diffuses into the metal, i.e., the surface or surfaces of the steel article or articles, to a depth and concentration that is dependent upon numerous metallurgical and process variables. The result is an iron-chromium alloy coating on the surface or surfaces of the steel article or articles, which is metallurgically bonded as an integral part of the base metal. Being a diffusion process, the structural modification occurs in the surface, not on the surface.

It has long been known that grain boundary carbides are characteristically present in chromized structures. Moreover, it is also known that these grain boundary carbides can produce a susceptibility of the chromium coating to intergranular attack in some service environments. Therefore, at least for these service environments it is desirable that the amount of grain boundary carbides that are present in the chromium coating be minimized to the extent possible. With respect to the subject method of applying a chromium coating to one or more surfaces of an article in accord with this aspect of the present invention, it has been found that the presence of grain boundary carbides in the chromium coating resulting from the practice of the subject method is in fact minimized thereby producing chromized coatings, which are characterized by the fact that their capability is maximized to resist corrosion and more specifically, the intergranular attack which is known to render the chromium coating susceptible to corrosion.

Thus, in accordance with one aspect of the present invention there has been provided a new and improved apparatus for applying a coating of chromium to one or more of the surfaces of an article as a means of providing protection thereto. Moreover, in accordance with another aspect of the present invention there is provided a new and improved method for applying a coating of chromium to one or more of the surfaces of an article as a means of providing protection thereto. In addition, in accord with the present invention an apparatus and a method are provided for applying a coating of chromium to one or more of the surfaces of an article wherein the surfaces to which the coating of chromium is applied may be the external and/or the internal surfaces of the article. Further, the apparatus and the method of the present invention for applying a coating of chromium to the surface of an article is characterized in that the chromium coating that is applied in accord therewith is thicker than that which it has heretofore been possible to provide through the use of prior art chromium coating methods. Additionally, in accordance with the present invention an apparatus and a method is provided for applying a coating of chromium to the surface of an article wherein the chromium coating that is applied in accord therewith contains a higher concentration of chromium than that which heretofore it has been possible to achieve through the use of prior art chromium coating methods. Also, the apparatus and the method of the present invention for applying a coating of chromium to the surface of an article is characterized in that the article to the surface of which in accord therewith the chromium coating is applied is larger in size than the size of the articles to which it has heretofore been possible to apply a chromium coating to the surface thereof through the use of prior art chromium coating methods. Furthermore, in accord with the present invention, an apparatus and a method is provided for applying a coating of chromium to the surface of an article which are relatively inexpensive to provide, which are relatively easy to employ and which are characterized in that the chromium coating provided thereby is better capable of resisting corrosion than the chromium coatings which heretofore have been available for use for the same purpose.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of my invention.

What is claimed is:

1. An apparatus particularly suited for applying a chromium coating to one or more of the surfaces of large size articles comprising:

a. support means including a stationary foundation operative as a thermal insulation barrier and a plurality of supports positioned on said stationary foundation in spaced relation one to another, said plurality of supports being operative as a thermal insulation barrier;

b. a retort mounted on said plurality of supports, said retort having a bottom and embodying sufficient internal size to accommodate therewithin one or more layers of large size articles;

c. a one-half inch thick layer spread evenly over said bottom of said retort of a powder containing as a source of chromium 3% ammonium chloride and 42% ferrochromium, the balance consisting of alumina;

d. a layer of large size articles to which a chromium coating is to be applied to one or more surfaces thereof positioned on said layer of powder spread over said bottom of said retort;

e. a four inch thick layer spread evenly over said layer of large size articles of a powder containing as a source of chromium 3% ammonium chloride and 42% ferrochromium, the balance consisting of alumina;

f. a cover sealed on said retort;

g. a furnace positioned in surrounding relation to said retort, said furnace embodying electrical heating elements, said furnace by means of said electrical heating elements heating uniformly throughout said retort and thereby also said layer of large size articles emplaced in said retort to a temperature of 2100° F. and thereafter maintaining said retort and said layer of large size articles uniformly heated throughout at a temperature of 2100° F. for a period of time of about 10 hours;

h. sealing means interposed between said furnace and said support means to effectuate a sealing off of said furnace and thereby of also said retort from the surrounding atmosphere;

i. first inlet passage means formed at a first location in said retort for supplying an inert gas to the interior of said retort for purging air therefrom;

j. first outlet passage means formed at a second location in said retort for conveying out of said retort the inert gas after the inert gas has flowed through said retort and by means of the inert gas the fumes entrained therewith that have been generated in said retort as said retort and said layer of large size articles are being heated uniformly throughout by means of said electrical heating elements of said furnace;

k. second inlet passage means formed at a first location in said furnace for supplying an inert gas within said furnace in surrounding relation to said retort for purging air from in surrounding relation to said retort; and l. second outlet passage means formed at a second location in said furnace for discharging from said furnace the inert gas after the inert gas has flowed within said furnace in surrounding relation to said retort and by means of the inert gas the fumes entrained therewith.

2. The apparatus as set forth in claim 1 wherein said stationary foundation is formed of a cast refractory material having good thermal insulation qualities.

3. The apparatus as set forth in claim 2 wherein each of said plurality of supports is formed of a cast-refractory material having good thermal insulation qualities.

4. The apparatus as set forth in claim 1 wherein the inert gas that is made to flow within said retort is argon.

5. The apparatus as set forth in claim 4 wherein the inert gas that is made to flow within said furnace in surrounding relation to said retort is argon.

* * * * *